US005582151A

United States Patent [19]

Wertheimer

[11] Patent Number: 5,582,151

[45] Date of Patent: Dec. 10, 1996

[54] METHOD AND SYSTEM FOR BALANCING POWER IN AN INTERNAL COMBUSTION ENGINE

[75] Inventor: Harry P. Wertheimer, Painted Post, N.Y.

[73] Assignee: Dresser-Rand, Corning, N.Y.

[21] Appl. No.: 513,210

[22] Filed: Aug. 10, 1995

[51] Int. Cl.[6] ..... F02D 41/14; F02D 41/36

[52] U.S. Cl. ..... 123/435

[58] Field of Search ..... 123/435, 436

[56] References Cited

U.S. PATENT DOCUMENTS

| | | | |
|---|---|---|---|
| 4,621,603 | 11/1986 | Matekunas | 123/435 |
| 4,732,126 | 3/1988 | Ikeura et al. | 123/435 |
| 5,058,551 | 10/1991 | Nakaniwa | 123/435 |

*Primary Examiner*—Andrew M. Dolinar
*Attorney, Agent, or Firm*—Nixon, Hargrave, Devans & Doyle

[57] ABSTRACT

A system for balancing power includes an internal combustion engine with at least two cylinders and a computer with a memory programmed to balance power output between the cylinders. Each of the cylinders has a fuel injector which injects fuel into the cylinder for a set period of time determined by a working pulse width signal received from the computer. The working pulse width signal is adjusted by a working balance factor which ranges from a first specified percentage to one-hundred percent before being transmitted to the fuel injector. The system operates in accordance with a set of instructions stored in the programmed memory which comprise: measuring peak firing pressure in each of the cylinders; generating an average peak firing pressure signal for each of the cylinders from the measurements of the peak firing pressure in each of the cylinders; generating a new balance factor for each of the cylinders in an iterative process from the working balance factors for each of the cylinders, a sensitivity constant, and the average peak firing pressure signal for each of the cylinders until at least one of the new balance factors is within a first preset amount of one hundred percent; and replacing the working balance factor for each of the cylinders with the new balance factor for each of the cylinders. The system and method may further comprise the step of triggering an alarm signal if any of the new balance factors is less than a specified percentage.

27 Claims, 14 Drawing Sheets

CAM OPERATED VALVE

EFGI AT 13ms, 100 RPM

3(a) 3(b)

| 5(a) | 5(b) |
|---|---|
| 5(c) | 5(d) |

| FIG.7a | FIG.7b |
|---|---|

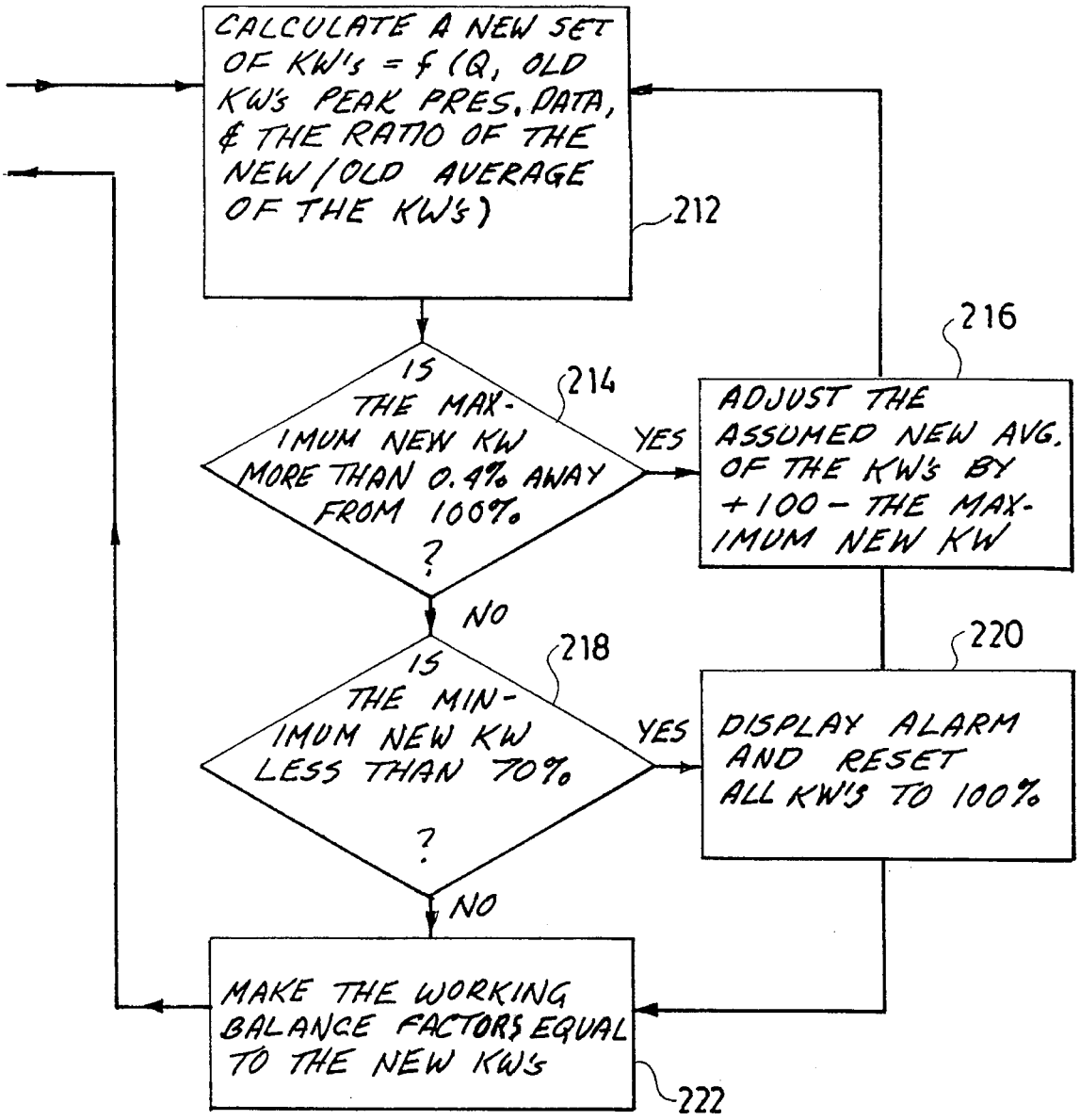
CALCULATE A NEW SET OF KW's = f (Q, OLD KW's PEAK PRES. DATA, & THE RATIO OF THE NEW/OLD AVERAGE OF THE KW's)
212
IS THE MAXIMUM NEW KW MORE THAN 0.4% AWAY FROM 100% ?
214
YES
ADJUST THE ASSUMED NEW AVG. OF THE KW's BY +100 − THE MAXIMUM NEW KW
216
NO
IS THE MINIMUM NEW KW LESS THAN 70% ?
218
YES
DISPLAY ALARM AND RESET ALL KW'S TO 100%
220
NO
MAKE THE WORKING BALANCE FACTORS EQUAL TO THE NEW KW's
222

METHOD AND SYSTEM FOR BALANCING POWER IN AN INTERNAL COMBUSTION ENGINE

FIELD OF THE INVENTION

This invention relates generally to a method and system for balancing power in an internal combustion engine, and more particularly relates to a method and system for balancing power in an internal combustion engine which uses the measured average peak output pressure for each cylinder in the internal combustion engine in an iterative process to modify the duration of fuel injection into each cylinder.

BACKGROUND OF THE INVENTION

A common problem with an internal combustion engine is that the power output in different cylinders within the internal combustion engine can be unbalanced. When the power balance between cylinders is unequal, the efficiency of the internal combustion engine is reduced. Additionally, when power balancing is not maintained, the life of the engine is reduced because of the added strain. Further, unbalance of power in the engine results in an increase in the amount of harmful emissions.

Prior methods and systems for balancing power have been inadequate. Most commonly, engines are balanced by measuring the average peak firing pressure of each cylinder and then using a manual restriction valve on each cylinder's fuel line to redistribute fuel to each of the cylinders. This method is laborious and when a load on the engine changes, the prior balancing is usually no longer acceptable.

SUMMARY OF THE INVENTION

A system for balancing power includes an internal combustion engine with at least two cylinders and a computer with a memory programmed to balance power output between the cylinders. Each of the cylinders has a fuel injector which injects fuel into the cylinder for a set period of time determined by a working pulse width signal received from the computer. The working pulse width signal is adjusted by a working balance factor which ranges from a first specified percentage to one-hundred percent before being transmitted to the fuel injector. The system operates in accordance with a set of instructions stored in the programmed memory which comprise: measuring peak firing pressure in each of the cylinders; generating an average peak firing pressure signal for each of the cylinders from the measurements of the peak firing pressure in each of the cylinders; generating a new balance factor for each of the cylinders in an iterative process from the working balance factors for each of the cylinders, a sensitivity constant, and the average peak firing pressure signal for each of the cylinders until at least one of the new balance factors is within a first preset amount of one hundred percent; and replacing the working balance factor for each of the cylinders with the new balance factor for each of the cylinders. The system and method may further comprise the step of triggering an alarm signal if any of the new balance factors is less than a specified percentage.

The system and method for balancing power in an internal combustion engine provides several advantages. With the method and system, the efficiency of the engine is improved, the life of the engine is extended, and the quantity of harmful emissions is reduced. The method and system can be adapted to work automatically, if desired. The method and system may also include an alarm system to prevent a harmful and dangerous buildup of fuel in one of the cylinders caused by one of the cylinders malfunctioning.

BRIEF DESCRIPTION OF THE DRAWINGS

FIG. 2(*b*) is a diagram illustrating injection timing in an engine with an electronic fuel injector in relation to the opening of the exhaust port;

FIG. 3(*b*) is a continuation of the flow chart shown in FIG. 3(*a*);

FIG. 4(*b*) is a diagram illustrating the working injection timing at a time during the initial acceleration of the engine for the embodiment disclosed in FIG. 1;

FIG. 4(*c*) is a diagram illustrating the working injection timing after three minutes have elapsed for the engine for the embodiment disclosed in FIG. 1;

FIG. 4(*d*) is a diagram illustrating the working injection time when the engine for the embodiment disclosed in FIG. 1 has reached 265 RPMs;

FIG. 4(*e*) is a diagram illustrating the working injection time when the engine for the embodiment disclosed in FIG. 1 has reached a speed of 330 RPM and full load;

FIG. 5(*b*) is a continuation of the flow chart shown in FIG. 5(*a*);

FIG. 5(*c*) is another continuation of the flow chart shown in FIG. 5(*a*);

FIG. 5(*d*) is a continuation of the flow chart shown in FIG. 5(*c*);

DETAILED DESCRIPTION OF THE INVENTION

Figure 1:
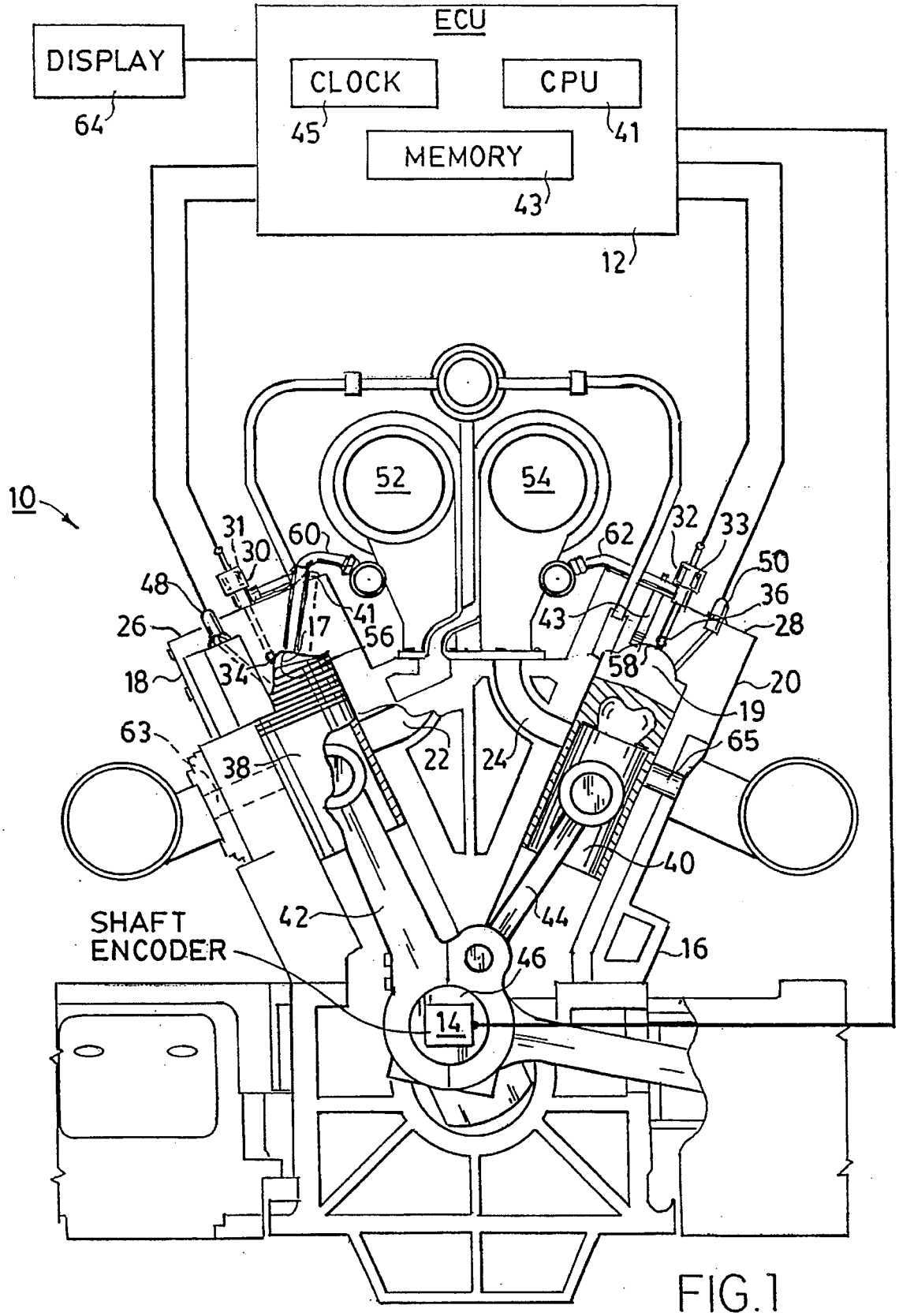
FIG. 1 is a perspective view of a two-stroke gaseous fuel engine with the electronic control unit in accordance with one embodiment of the present invention.

A method and system for balancing power in an internal combustion engine in accordance with one embodiment of the present invention is illustrated generally in FIG. 1. The system includes an engine 10 with cylinder 18 and 20, an electronic control unit ("ECU") 12, and fuel injectors 30 and 32 and may include pressure transducers 48 and 50.

Referring more specifically to FIG. 1, a perspective view of the engine 10 with ECU 12, a shaft encoder 14, cylinders 18 and 20, and fuel injectors 30 and 32 in accordance with one embodiment of the present invention is illustrated. Engine 10 has an engine block 16 with two cylinders 18, 20 with combustion chambers 17, 19, exhaust ports 22, 24 which lead to exhaust ducting 52, 54, and intake ports 63, 65. Although in this particular embodiment a two-stroke engine 10 with two cylinders 18, 20 is shown, the invention is also applicable to any type of internal combustion engine 10 with two or more cylinders. The cylinder heads 26, 28 seal the top of cylinders 18, 20. Fuel injectors 30, 32, such as electro-hydraulic fuel injectors or solenoid fuel injectors and spark plugs 41, 43 are located in cylinders heads 26, 28. Fuel injectors 30, 32 include valves 34, 36 which are adjacent roofs 56, 58 of cylinder heads 26, 28 and fuel injector actuators 31, 33 which control valves 34, 36. The valves 34, 36 control when fuel is metered out to cylinders 18, 20. Fuel lines 60, 62 supply gaseous fuel, such as natural gas, to fuel injectors 30, 32 or any other type of fuel required to operate engine 10. Pistons 38, 40 reciprocate in cylinders 18, 20 and are attached to connecting rods 42, 44. Connecting rods 42, 44 are also connected to a crankshaft 46 which converts the motion of each piston 38, 40 in the cylinders 18, 20 to rotary motion.

ECU 12 includes a microprocessor or CPU 41, a memory 43, and a clock 45 and is coupled to fuel injector actuators 31, 33, such as electro-hydraulic mechanisms or solenoids, shaft encoder 14, pressure transducers 48 and 50, and display 64. The ECU 12 controls when the fuel injector actuators 31, 33 open and close valves 34, 36 for fuel injectors 30, 32. Memory 43 has a program, stored in a manner well known in the art, which causes the automatic operation of the injection timing and semi-automatic and automatic operation of the power balancing control.

Shaft encoder 14 is connected to crankshaft 46 and generates a "zero-reference" pulse or "reset" pulse I1 each time the shaft encoder detects a complete revolution of the crankshaft 46. The time which the reset pulse is generated each revolution of the crankshaft 46 will depend on how shaft encoder 14 is mounted on crankshaft 46. Shaft encoder 14 also generates a series of evenly spaced counter pulses during each complete revolution of the crankshaft 46. In this embodiment, shaft encoder 14 generates 1440 counter pulses each revolution of crankshaft 46.

Pressure transducers 48, 50 are located in cylinder heads 26, 28 and monitor the peak pressure output of cylinders 18, 20. Although pressure transducers 48, 50 are shown, any type of sensors which could measure an index of output power in cylinders 18, 20 could be used.

The engine 10 in this particular embodiment operates on a two-stroke cycle. For ease of discussion, the operation of the engine 10 will hereinafter be explained with reference to only one cylinder 18, however the operation explained below is applicable to all of the cylinders in an engine in accordance with this invention. In a two-stroke engine, such as 10, the spark plug 41 ignites the mixture of fuel and air in the combustion chamber 17, usually just before the piston 38 reaches the TDC of its' stroke. The expanding products of combustion force the piston 38 downward. Part way down, the piston 38 uncovers the exhaust port 22 and a short distance further the piston 38 also uncovers the intake port 63. A supercharger (not shown) driven either by the crankshaft 46 or from a turbine in the exhaust ducting 52 and 54, provides air under pressure which issues into the cylinder 18 through the intake port 63 and scavenges the cylinder 18 of most of the exhaust gases. As the piston 38 moves upward, this scavenging process continues until first the intake port 63 and then the exhaust port 22 are again covered by the piston 38.

When commanded to do so by the ECU 12, actuator 31 will cause the fuel injector 30 to open. The injector 30 is commanded to open either during or after the period that the exhaust port 22 is uncovered by the piston 38. The pressure of the fuel in fuel line 60 is well above the scavenge air pressure at intake port 63. Thus fuel will flow into the cylinder 18 until either the pressure in the cylinder rises above the fuel pressure or the ECU 12 commands the injector to close. The amount of fuel delivered during a cycle is determined primarily by the duration of the working pulse width (WPW) multiplied by the balance factor from the ECU 12, as explained in greater detail later. How much fuel escapes through exhaust port 22 and how much time is available for mixing the fuel and air depends on the timing for the start of a working injection time (WIT), which is the time in terms of crank angle with respect to a fixed reference point, such as top dead center (TDC), at which fuel injectors 30, 32 begin to inject fuel into cylinders 18, 20, and also on the duration of injection. Piston 38 is driven up towards the cylinder head 26 pushing the fuel, air and residual exhaust up towards cylinder head 28 and also out exhaust port 22. Eventually, when piston 38 passes exhaust port 22, the fuel, air, and any remaining exhaust are sealed in cylinder 18. When the piston 38 nears the top of cylinder 18, the air-fuel mixture is ignited by spark plug 41, driving the piston 38 down to begin another cycle.

Figure 2A:
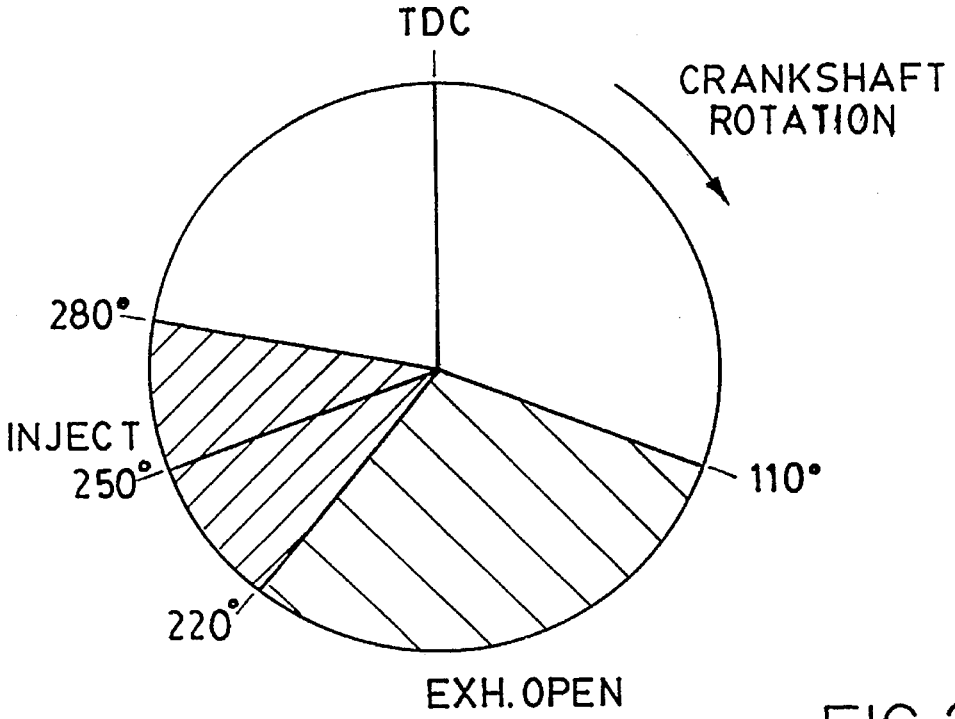
FIG. 2(a) PRIOR ART
FIG. 2(*a*) is a diagram illustrating injection timing in an engine with a prior art mechanical cam driven valve train in relation to the opening of the exhaust port.
Figure 2B:
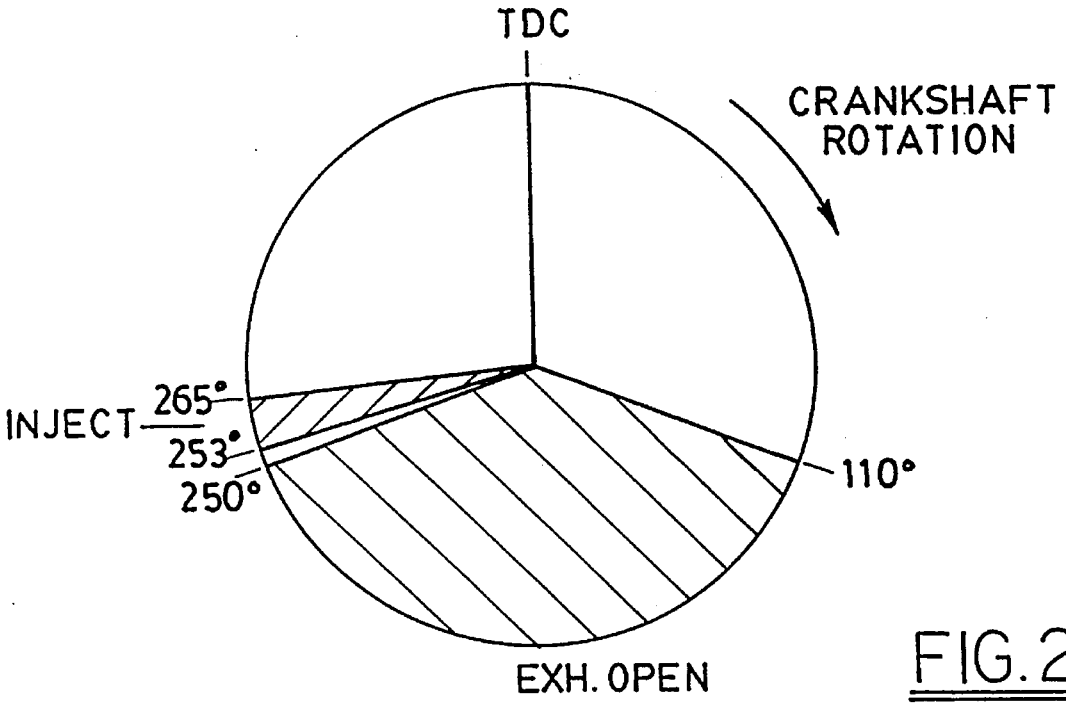

Referring to FIGS. 2(*a*) and 2(*b*), two diagrams illustrating injection timing with respect to exhaust port 22 opening in an engine are illustrated. In this particular embodiment, exhaust port 22 is open between 110° after top dead center ("ATDC") and 250° ATDC. In FIG. 2(*a*), fuel injector 30 is operated by a prior art mechanical cam-driven valve train which is not shown. As discussed earlier, the timing of the start of the injection time and the duration of the injection is dictated by the cam's profile and the cam's phase relationship to the crankshaft. In this particular example, the fuel injector is opened at 220° ATDC and is closed at 280° ATDC. As shown by FIG. 2(*a*), the fuel injector is open while the exhaust port is open allowing fuel to escape from cylinder 18. In FIG. 2(*b*), the results of a fuel injector 30 operated in accordance with the present invention are shown. Fuel injector 30 is open at 253° ATDC and is closed at 265° ATDC. Accordingly, with ECU 12 the start and duration of the injection by fuel injector 30 can be adjusted so that fuel is only injected when exhaust port 22 is closed and only for the specific amount needed. As a result, less if any fuel escapes through exhaust port 22 and the amount of fuel delivered is the optimum amount necessary.

Figure 3A:
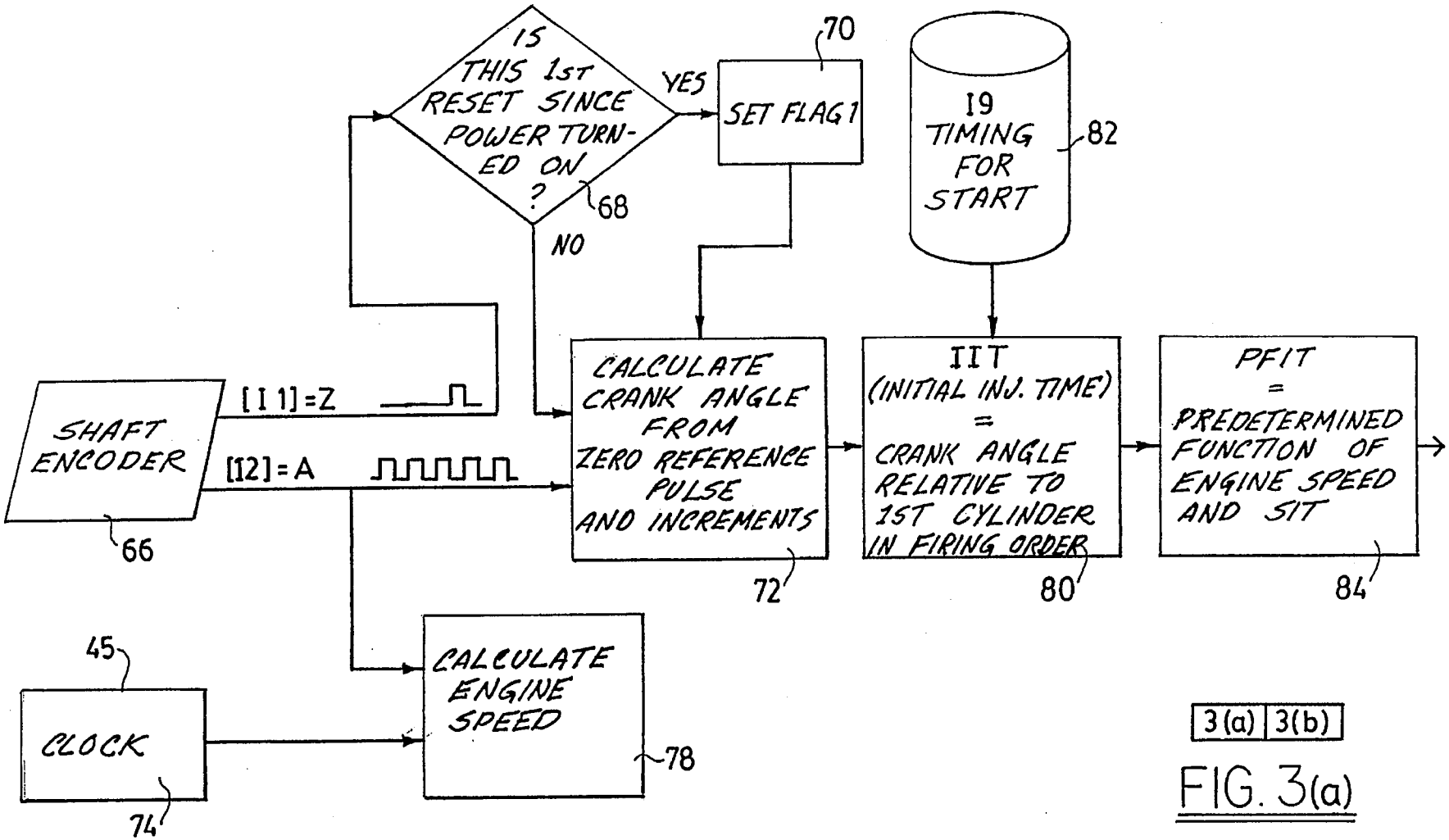
FIG. 3(*a*) is a flow chart illustrating the operation of the automatic injection timing control.
Figure 3B:
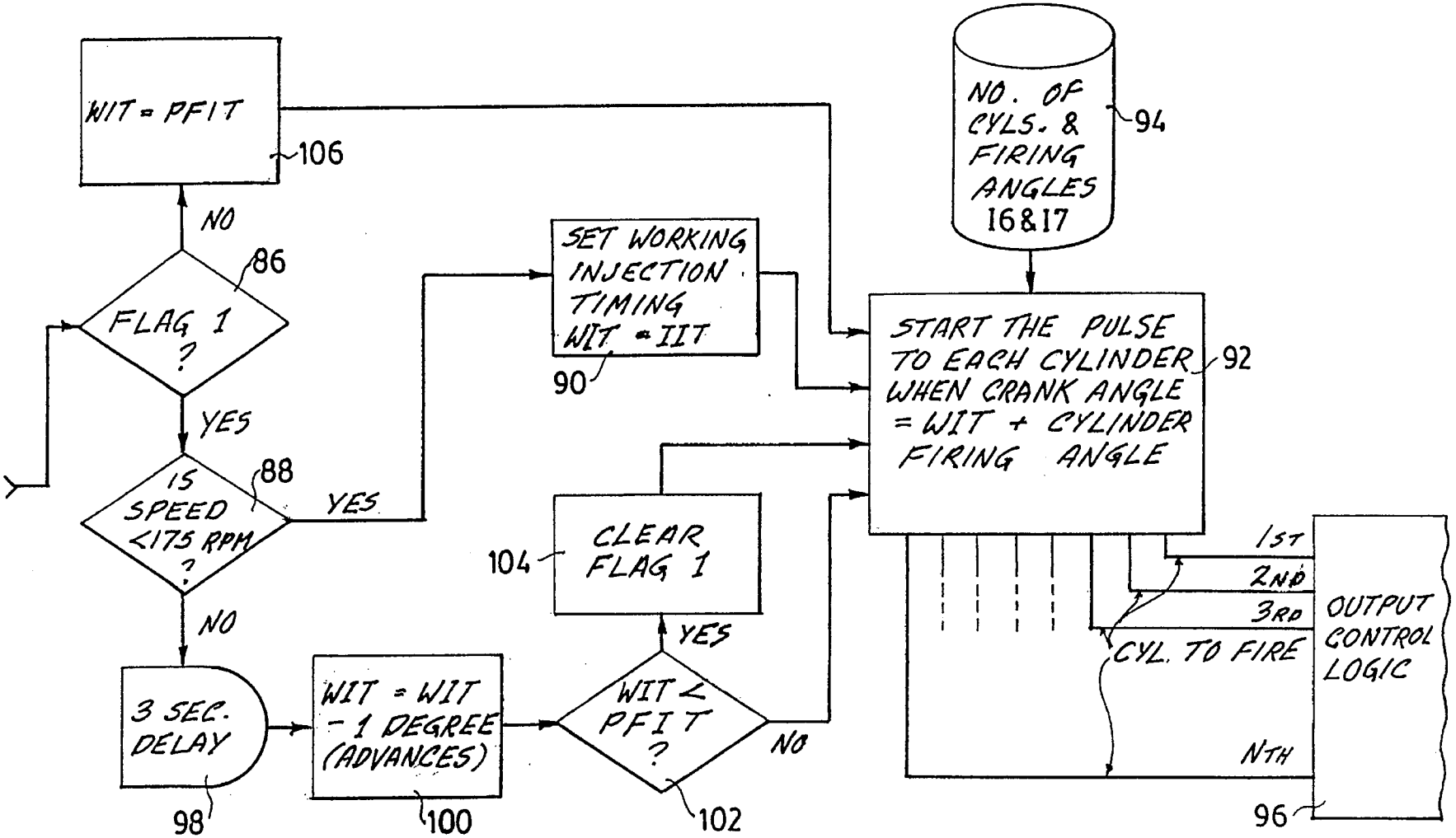
Figure 4A:
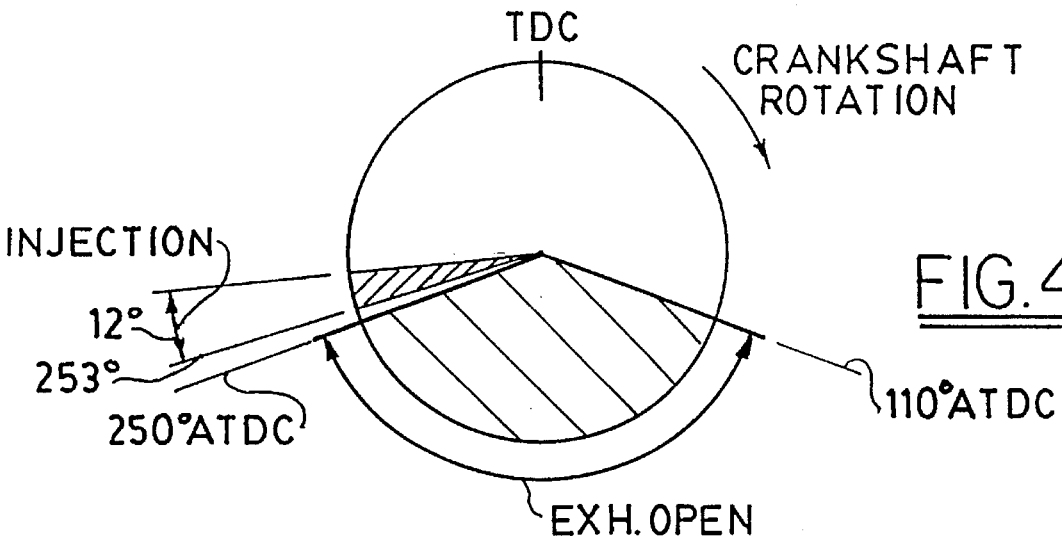
FIG. 4(*a*) is a diagram illustrating the working injection timing at start-up for the embodiment disclosed in FIG. 1.
Figure 4B:
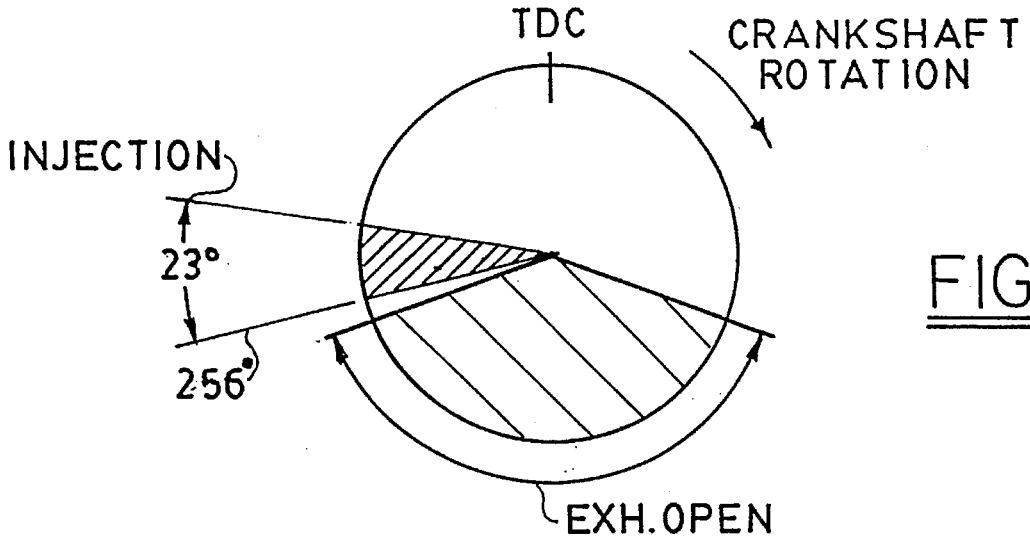
Figure 4C:
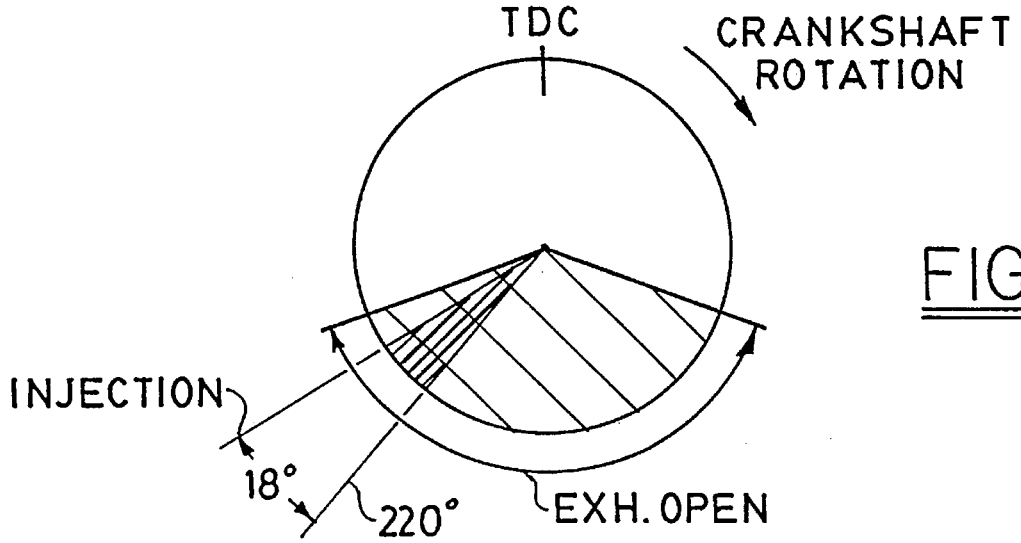
Figure 4D:
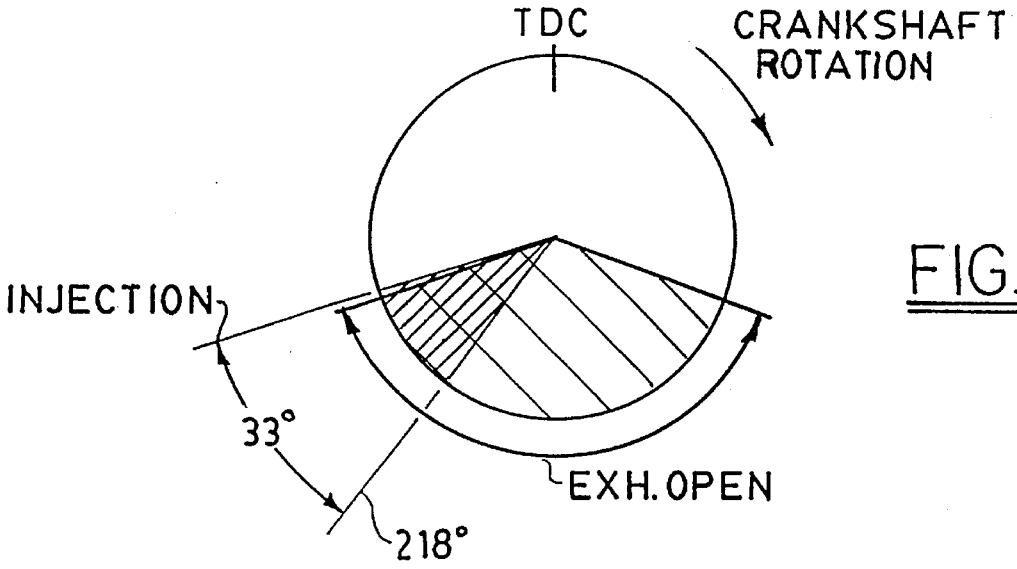
Figure 4E:
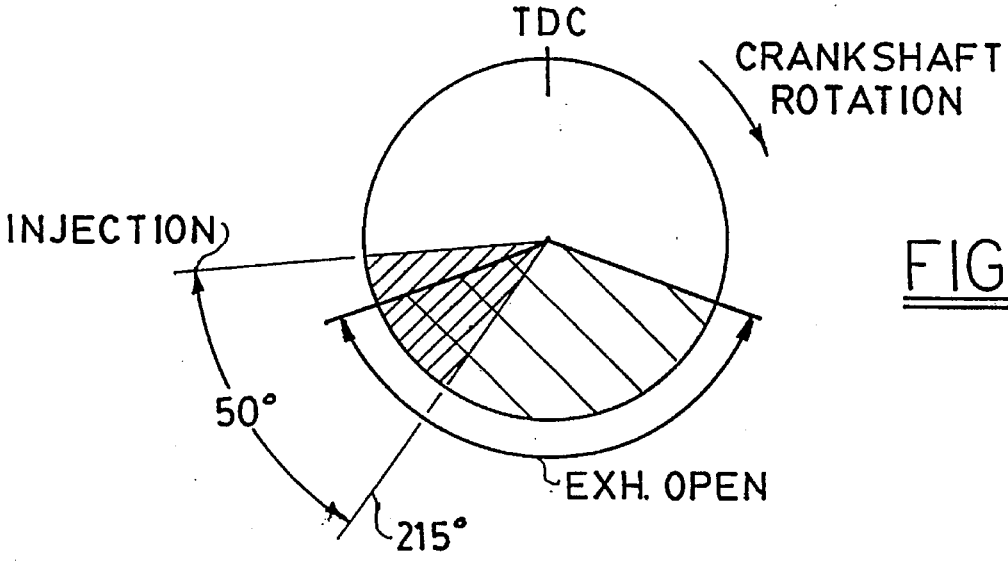
Figure 5A:
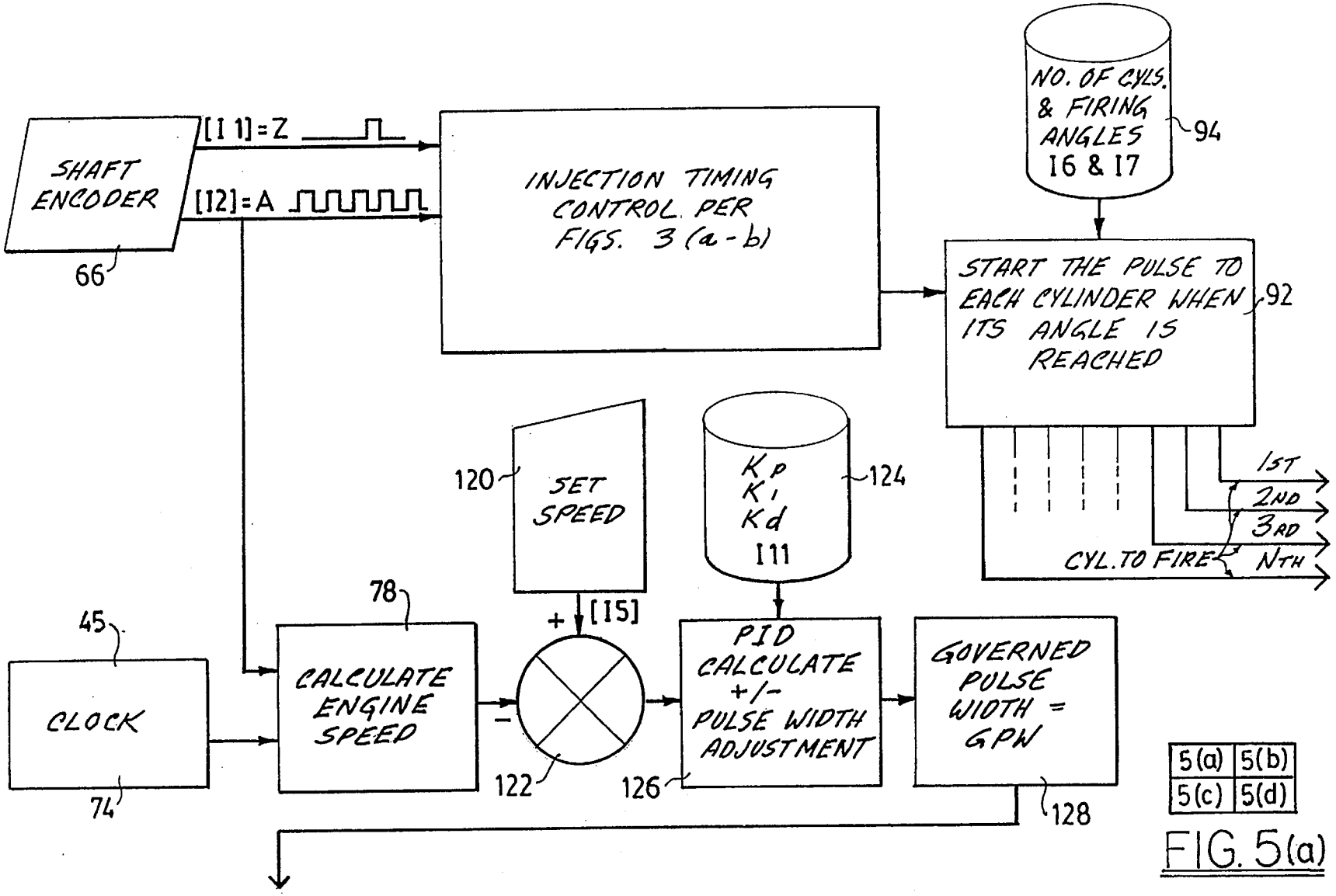
FIG. 5(*a*) is a flow chart illustrating the operation of the electronic power balancing control.
Figure 5B:
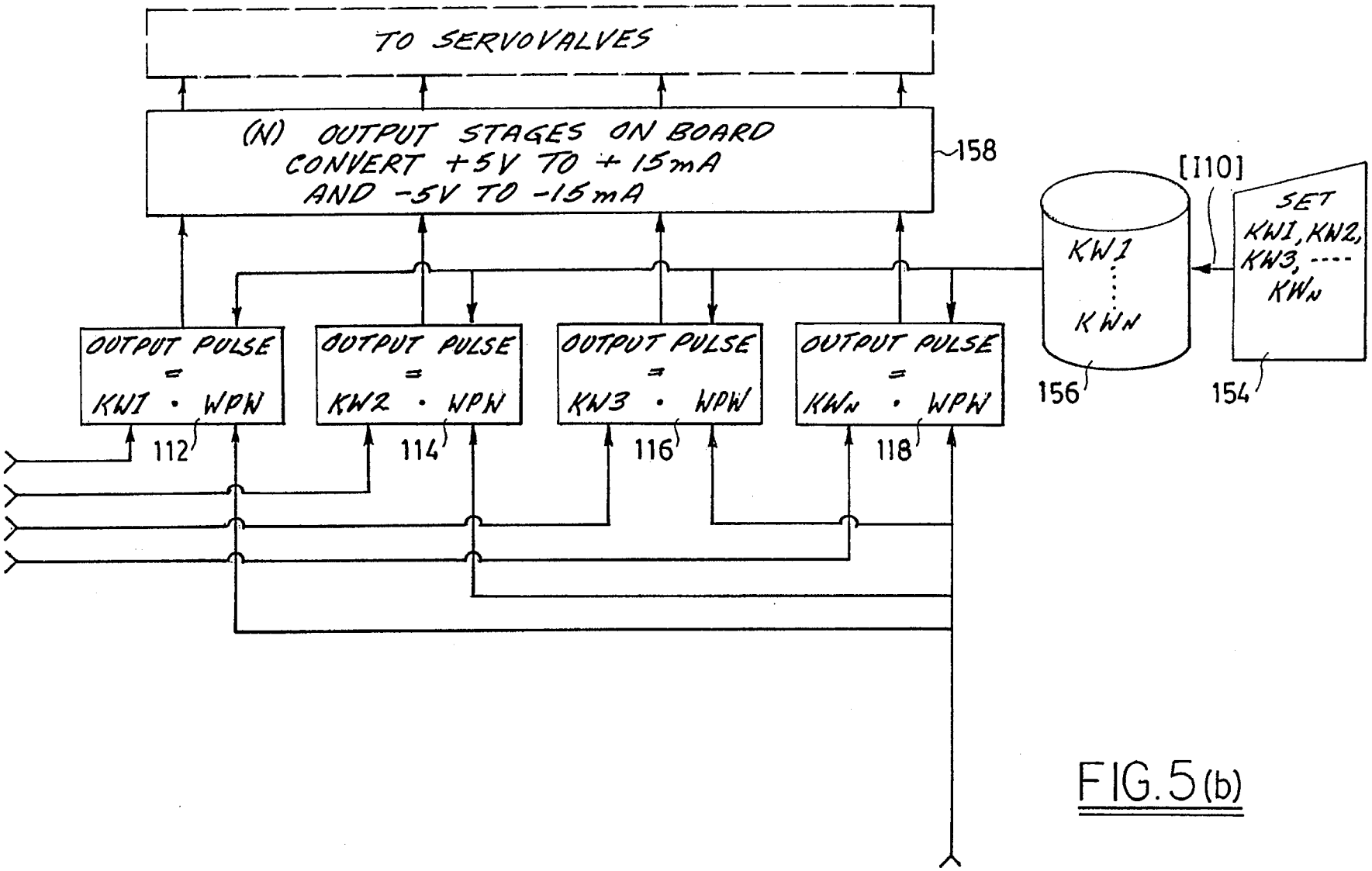
Figure 5C:
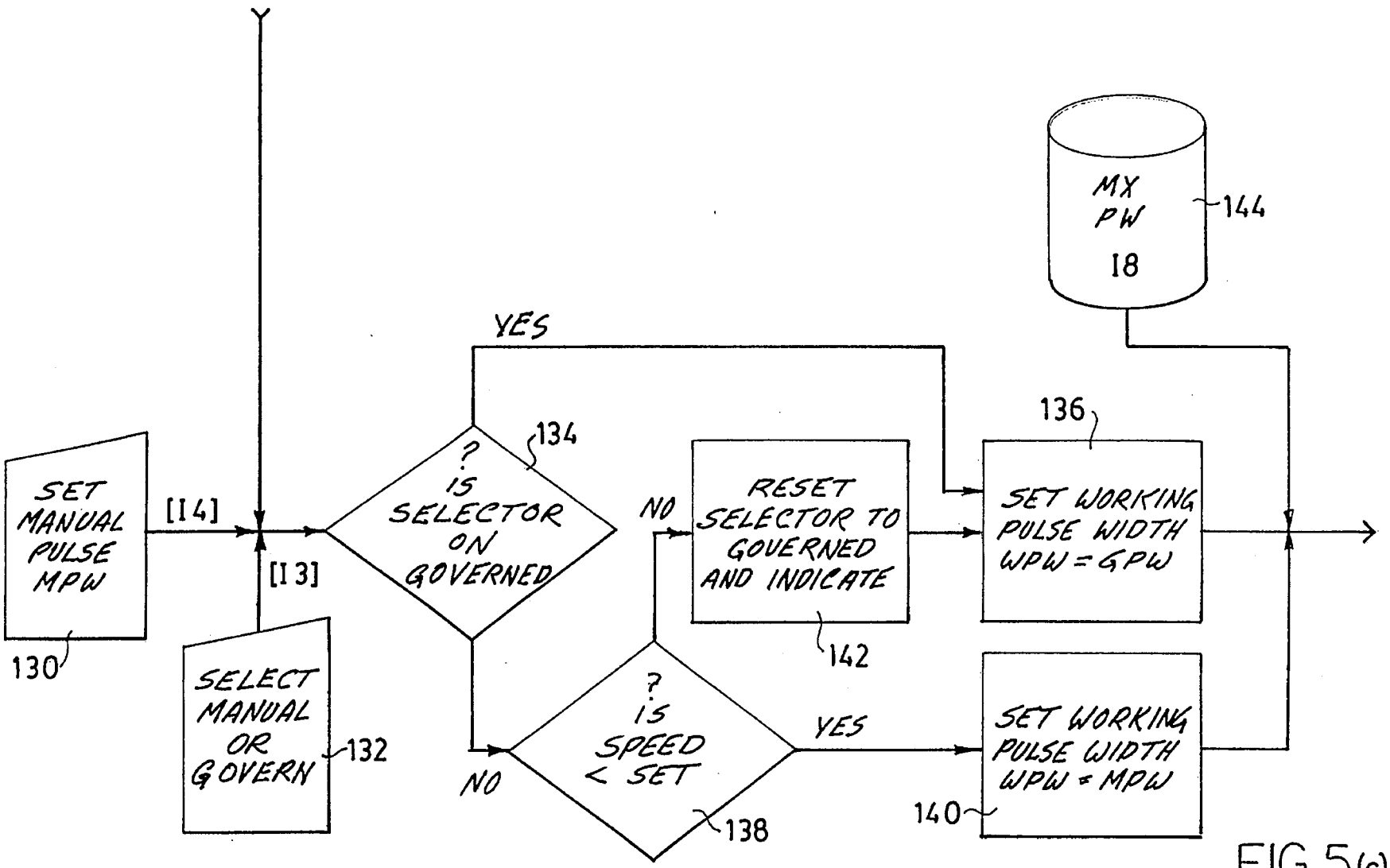
Figure 5D:
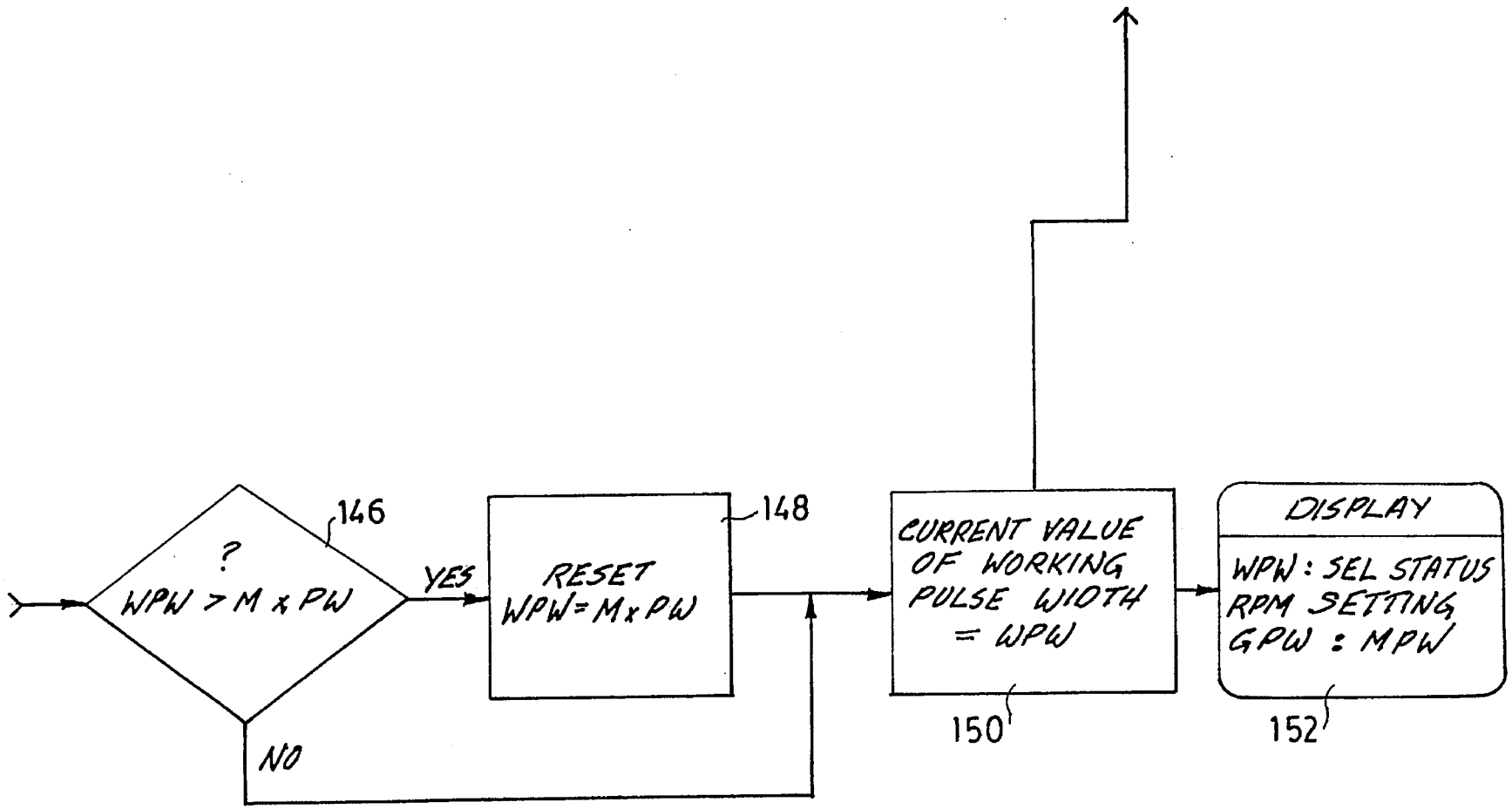

Referring to FIGS. 3(*a*) and 3(*b*), a flow chart illustrating the steps of operation of the injection timing control is shown. In this particular embodiment, before fuel and ignition are turned on in the engine 10, power to ECU 12 is turned on, and the engine 10 must be first cranked-up by a suitable starter motor or other device (not shown) to operate at about 80 RPMs. Once the engine 10 is running at about 80 RPMs, fuel and ignition for engine 10 are turned on. Next, the shaft encoder 14 begins to monitor the revolutions of crankshaft 46 and generates a "zero-reference" or "reset" pulse I1 each time shaft encoder 14 detects a revolution of crankshaft 46 (Step 66). The relationship of the reset pulse I1 to the crankshaft's angular position depends upon the installation of shaft encoder 14, but once shaft encoder 14 is mounted the reset pulse will occur at the same crank angle every revolution. Shaft encoder 14 also generates a series of counter pulses 12 during each revolution of the crankshaft 46 (Step 66). In this particular embodiment, shaft encoder 14 outputs 1440 counter pulses per revolution of crankshaft 46. With the reset pulse I1 and counter pulses I2, ECU 12 always knows the angular position and speed of crankshaft 46, as explained further. ECU 12 monitors shaft encoder 14 in Step 68 and when ECU 12 detects the first reset pulse I1, ECU 12 checks to see if the engine speed is less than 25 RPMs and if the speed is less than 25 RPMs then the YES branch is taken to set an internal flag in memory 43 to one (Step 70). When the next reset pulse I1 is detected by ECU 12, the speed is checked again and if the engine speed is not less than 25 RPMs then the NO branch will be taken from Step 68. Next, either from the NO branch from Step 68 or the set flag in Step 70, the angular position of crankshaft 46 is calculated from the reset pulse I1 and the 1440 counter pulses I2 from shaft encoder 14 to within a quarter of a degree of resolution (Step 72). Meanwhile, in Step 74 a clock 45 outputs a continuous stream of pulses at a fixed frequency which is used with the counter pulses I2 from shaft encoder 14 to calculate engine speed in Step 78.

Once the angular position of crankshaft 46 has been calculated in Step 72, the initial injection timing or ("IIT") is calculated for each cylinder 18 and 20 (Step 80). IIT is the time in terms of crank angle from a fixed reference point, such as reset pulse I1, at which ECU 12 transmits a signal to fuel injector actuator 31 to open valve 34 for fuel injector 30 to start the injection of fuel into combustion chamber 17 in cylinder 18. IIT is established in memory 43 through operator entry I9 via means such as a keypad (not shown) and becomes input in Step 82. For example, if it is was desired to start the pulse for the first fuel injector to inject fuel at 200 degrees after TDC, and reset pulse I1 happened to wind up at 180 degrees after TDC, then the operator would enter twenty degrees to correct for the error and ECU 12 would signal first fuel injector actuator 31 to open the valve 34 twenty degrees after ECU 12 received the reset pulse I1 from shaft encoder 14.

Next in Step 84, the injection timing as a function of engine speed ("programmed function injection timing" or "PFIT") is calculated. After the engine 10 is started and is running at normal idle speed, PFIT is the empirically determined optimum time in terms of crank angle from a fixed reference point, such as the reset pulse I1, for fuel injector actuator 31 to open valve 34 to start the injection of fuel by fuel injector 30 (Step 84). In this particular embodiment, the predetermined function by which PFIT is calculated is: PFIT=IIT−0.046×RPM−27.8, although the predetermined function can vary based upon the particular embodiment. Both IIT and PFIT are stored in memory 43 in ECU 12.

Once PFIT has been calculated, the status of the flag is checked (Step 86). If the flag is set to one, then engine speed, which was calculated earlier in Step 78, is checked (Step 88). If the speed of crankshaft 46 has not yet reached 175 RPMs, then the YES branch is taken to set working injection time ("WIT") to IIT (Step 90). Before WIT is set to IIT, WIT is at some arbitrary default setting. Although 175 RPMs is used in this particular embodiment, the speed selected as the limit can vary as needed and desired. Once WIT has been set to IIT, the output pulse to fuel injector actuator 31 in cylinder 18 is started when the crankshaft's crank angle (relative to the reset pulse I1)=WIT+the cylinder's firing angle (step 92). The firing angle for the first cylinder 18 in the firing order is normally zero. The number of cylinders 16 and their firing angles 17, needed for the calculations in Step 92, are input in Step 94, to ECU 12 and are usually stored in memory 43. Next, the start pulse for fuel injector actuator 31 for cylinder 18 is sent to the output control logic (Step 96). The above-noted steps are repeated for each crankshaft revolution, with the variations to the above-noted steps described below.

ECU 12, as is typical for computers, loops repeatedly through its program which includes the coding for the equivalent of steps shown in FIGS. 3(*a*) and 3(*b*). When ECU 12 encounters the reset pulse I1 a second or subsequent time, the engine speed is checked and if the engine speed is not less than 25 RPMs then the NO branch is taken in step 60. Further along, the status of the flag is checked again (Step 86) and if the flag is set at one, then the speed of engine 10 is again checked (Step 88). If the speed of the engine is equal to or greater then 175 RPMs, then the NO branch is taken to start a three second delay (Step 98). The delay is used to advance WIT gradually from its retarded condition set for starting at ITT to the optimum timing for the engine speed which is PFIT. Although a three second delay has been selected, the length of the delay can vary as needed and desired. After the delay has expired, the WIT is advanced one degree towards PFIT (Step 100), although the amount of advancement can vary as needed and desired. Next, WIT is compared with the PFIT in Step 102. If WIT is equal or greater than PFIT, then the NO branch is taken and the output pulse to fuel injector actuator 31 in cylinder 18 is started when the crankshaft crank angle=WIT+the cylinder's firing angle (Step 92). If WIT is less (more advanced) than PFIT in Step 102, then the YES branch is taken to clear the flag by resetting the flag to zero (Step 104) and then the output pulse to fuel injector 30 in cylinder 18 is started when the crankshaft crank angle=WIT+the cylinder's firing angle in Step 92.

The next time through, when the flag has been cleared, then in Step 86 the NO branch is taken. When the NO branch is taken, WIT is set equal to PFIT in Step 106 and the output pulse to fuel injector actuator 31 in cylinder 18 is started when the crankshaft's crank angle=WIT+the cylinder's firing angle (Step 92). WIT will remain equal to PFIT until the power to ECU 12 is shut off or until the engine's speed drops below a preset lower speed, 25 RPMs in this embodiment.

One example of a software implementation of the injection timing control is set forth below. The program is written in a special form of BASIC computer language, although the injection timing control could be implemented in any desired computer language suitable for ECU 12.

```
7000  'Automatic Injection Timing Control
      if RPM < 25 then FLAG1 = 1 'Happens on start up only
      PFIT = IIT - 0.077 * RPM - 20.6
      if FLAG1 = 0 then WIT = PFIT: goto 7200 'Up to
      speed & timed out
      if RPM < 175 then WIT = IIT: goto 7200
      wait 200: WIT = WIT - 1 'advance 1 deg. every i.e. 2 sec
      if WIT < PFIT then FLAG1 = 0 'End the timed
      advancing
```

Subsequent coding (not shown), specific to the computer used and which can be created in manners well known in the art, converts the value of WIT which is in degrees to encoder pulses, in this case multiplying by 4, and then sets the main injector timing.

Referring to FIGS. 4(*a–e*), diagrams illustrating the working injection time at different stages of the engine's operation are illustrated. In this particular embodiment, exhaust port 22 is open between 110° and 250° ATDC, and, for simplicity in discussion, the reset pulse I1 occurs at top dead center (TDC). The location of the opening of the exhaust port and reset pulse I1 remains the same each crankshaft revolution in FIGS. 4(*a–e*).

In FIG. 4(*a*), engine 10 is being cranked at 100 RPM, engine 10 and ECU 12 having previously been shut down. In accordance with the foregoing, WIT equals IIT which is set to cause injection of fuel to start at 253° ATDC, 3° after exhaust port 22 has closed. The relatively short pulse duration used for starting causes injection valve 34 to remain open only 12° at this low engine speed.

In FIG. 4(*b*) engine 10 has accelerated to 200 RPM, but virtually no time has elapsed since engine 10 accelerated past 175 RPM. As a result, WIT still equals IIT. The higher speed increases the angle through which the crank rotates between the time ECU 12 generates the start of the pulse and the time injector 30 starts to open. Therefore, the start of fuel injection occurs at a larger crank angle, 256° ATDC. The duration of injection may have shortened a bit in terms of time, but owing to the higher RPM, injection valve 34 now stays open for 23° of crank rotation.

In both FIGS. 4(*a*) and 4(*b*), none of the injection occurs during the period that exhaust port 22 is open, effectively minimizing the loss of any fuel through exhaust ducting 52. However, FIG. 4(*b*) illustrates a relatively small angle until the ignition (just before TDC) occurs. This reduces the time available for the fuel and air to mix and is the reason that the injection timing is advanced as explained below.

In FIG. 4(*c*), conditions of engine speed (and load) are the same as those in FIG. 4(*b*), but a time, such as 3 minutes, has elapsed which has caused WIT to be decremented enough until it is made equal to PFIT. Thus, after 3 minutes the injection of fuel starts at 220° and lasts for 18°. The added mixing time makes engine 10 more efficient so the duration of the pulse is reduced to decrease fuel quantity. Decreasing the fuel quantity maintains the engine speed at 200 RPM. Even though the injection is now open during the period that the exhaust port 22 is open, the amount of fuel escaping is not great because of the speed of engine 10 and the location of injector 30 in cylinder 18.

FIG. 4(*d*) represents operation of engine 10 at an intermediate speed of 265 RPM and a higher load than FIG. 4(*c*). PFIT, to which WIT is now set, has caused the start of injection to further advance to 218° ATDC. The increased load requires more fuel and thus a longer injection duration, resulting in injector 30 being open for 33°.

In FIG. 4(*e*) engine 10 has reached its rated speed of 330 RPM and full load. Injection of fuel has been further advanced to 215° and WIT=PFIT. The higher load requires the longer injector open period, resulting in a crank angle of 50° for this period.

With the injection timing control, fuel loss through exhaust port 22 at start-up and emissions of unburned hydrocarbons can be minimized. Additionally, fuel injector 30 is set at or near an optimum fuel injection setting for starting the injection of fuel to cylinder 18 over a range of speeds and conditions. Further, the injection timing can be adjusted to operate at optimum levels for gaseous fuel, as opposed to liquid fuel, because with gaseous fuel, there is no need to provide time for the fuel to vaporize during the fuel injection cycle.

Referring to FIGS. 5(*a–d*), a flow chart illustrating the steps of operation of the power balancing control is shown. As described earlier, when engine 10 is started and ECU 12 is turned on, shaft encoder 14 generates a "zero-reference" or "reset" pulse I1 and a series of counter pulses I2 (Step 66). Again in this particular embodiment, shaft encoder 14 generates 1440 counter pulses I2 per revolution. ECU 12 monitors shaft encoder 14 and based upon the reset pulse I1 and counter pulses I2 calculates the angular position of crankshaft 46 (Step 72).

ECU 12 calculates the point to initiate the output pulse for fuel injector actuator 31 for cylinder 18 relative to the first to fire (Step 92), as described in FIGS. 3(*a*) and (*b*). The output pulses calculated in Step 92 are directed by ECU 12 to Steps 112, 114, 116 and 118, which are discussed later.

Meanwhile, clock 45 generates the clock signal in Step 74 which is used along with counter pulses I2 from shaft encoder 14 to calculate the engine speed (Step 78). More specifically, the number of counter pulses I2 is divided by the clock signal to give a speed which may be scaled to RPMs. Once the speed is calculated, in Step 78, the calculated speed is compared in step 122 to a set speed I5 entered by an operator in Step 120. A comparator outputs an error signal which is the difference between the calculated speed and set speed. The error signal along with governor gain factors: Kp=proportional gain, Ki=integral gain, and Kd=derivative gain input in Step 124, are used by ECU 12 in a manner well known in the art to modify the pulse duration or pulse width ("PW") (Step 126). PW signals to fuel injector actuator 31 how long each fuel injector 30 should remain open. The PW corrected by the error signal is known as governed pulse width ("GPW") and is stored in memory 43 in ECU 12 (Step 128).

Next, in Step 130 a manual pulse width I4 ("MPW") is input and in Step 132 a selection of either MPW or GPW, I3, is input. ECU 12 checks to see if GPW has been selected (Step 134). If GPW is selected in Step 134, then the YES branch is taken and the working pulse width ("WPW") for each cylinder is set equal to GPW (Step 136). If GPW was not selected in Step 134, then the NO branch is taken and if the speed is below the set speed in Step 138, then the YES branch is taken and WPW is set to MPW (Step 140). This is normally used only for starting the engine. If the speed is equal to or greater then the set speed in Step 138, then the NO branch is taken and the switch is reset to select GPW (Step 142). Once the switch is reset in Step 142, WPW is set to GPW (Step 136).

Next in Step 144 a maximum allowable pulse width ("M×PW") is entered. WPW is then compared against M×PW to see if it exceeds M×PW in Step 146, to prevent WPW from exceeding a value that could leave the fuel gas injector open too long for proper engine operation (Step 146). If WPW is greater than M×PW in step 146 then the YES branch is taken and WPW is reset to M×PW (Step 148). If WPW is equal to or less than M×PW in Step 146, then the NO branch is taken and WPW remains the same.

Next, the current value of WPW is set to WPW (Step 150). The value for WPW may be displayed by display 64 along with RPMs and GPW (Step 152). Next, each fuel injector's WPW is adjusted by multiplying it by a balance factor, KW1, KW2, KW3, and KWn, where KWn represents the balance factor for the last cylinder (Steps 112, 114, 116, and 118). ECU 12 monitors the output power in each cylinder 18 and 20 with pressure transducers 48 and 50 (Steps 154) and derives a balance factor for each cylinder to balance the power output by all of the cylinders (Step 156). Preferably, the balance factors are between 0.75 and 1.00. A method and system for deriving the balance factors and balancing the output power in engine 10 is explained in greater detail below with reference to FIGS. 6 and 7. For example, ECU 12 may calculate what the average power output is from each cylinder 18 and 20 and adjust the power in each cylinder 18 and 20 to the average output power by the cylinders 18 and 20 or the ECU 12 may adjust the output power in each to some preselected power level. Once the balance factors have been multiplied with the WPW in Steps 112, 114, 116, and 118, then the output pulses are sent to an output stage which converts the voltages to currents which can be used by the fuel injection actuator 31 to operate the valve 34 in the fuel injector 30. (Step 158). With power balancing, engine 10 will run more smoothly and the life of engine 10 will be increased.

Figure 6:
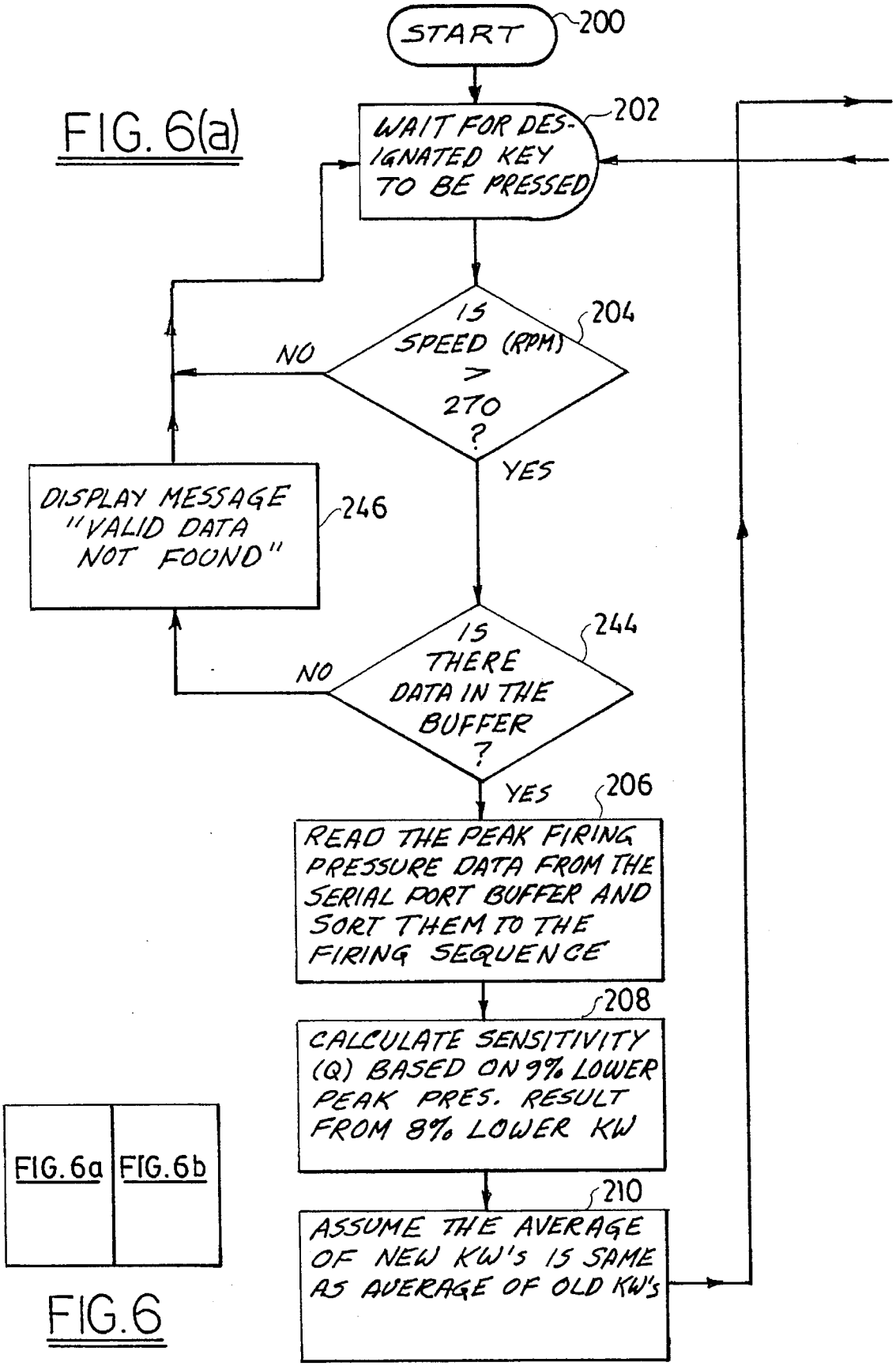
FIG. 6 is an flow chart illustrating the semi-automatic operation of the power balancing system.
Figure 6B:
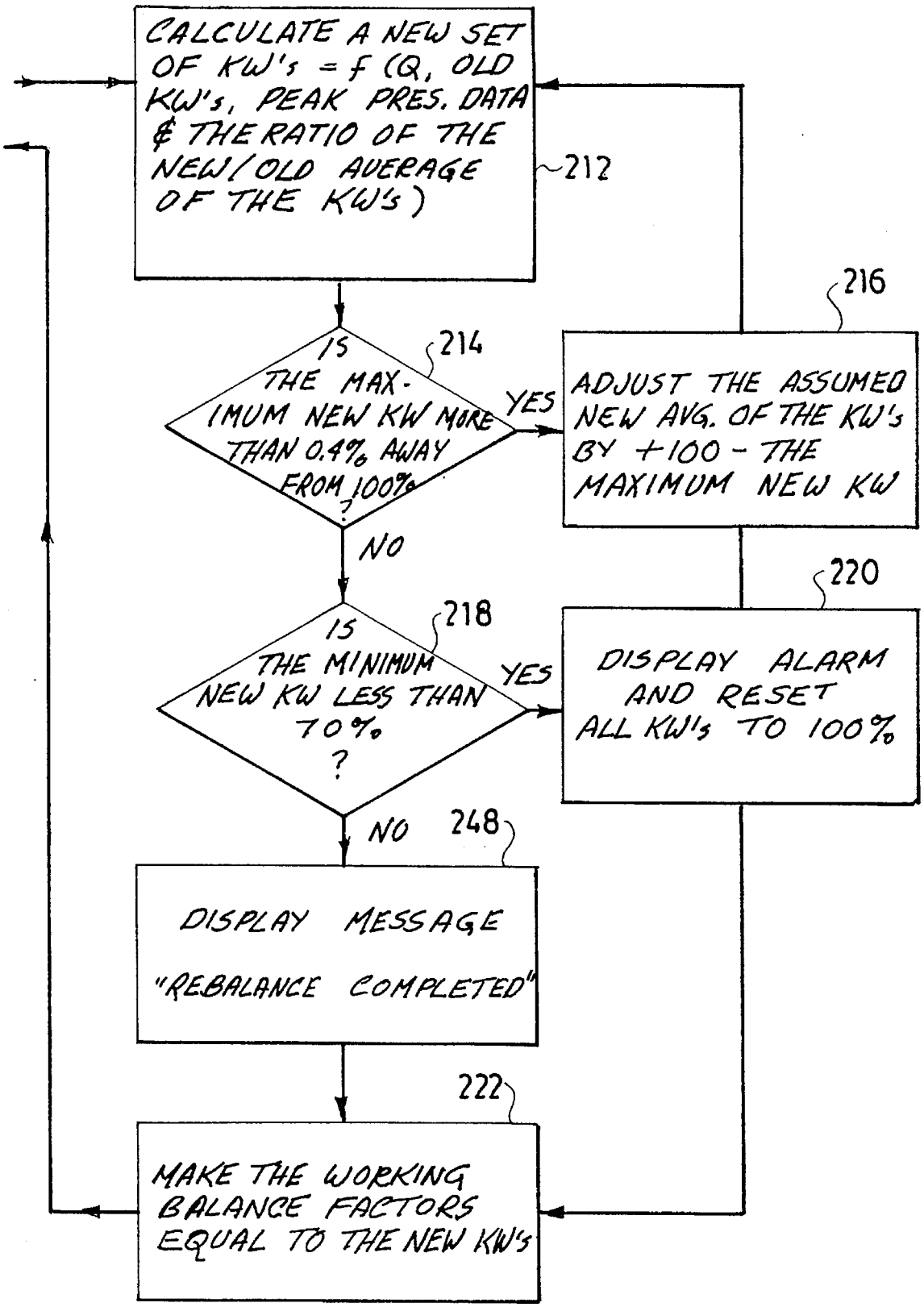

Referring to FIG. 6, a flow chart of the operation of a semi-automatic power balancing method and system is illustrated. Although the system and method described with reference to flow charts in FIGS. 6 and 7 refer to the two-stroke, gaseous fuel engine 10, any type of internal combustion engine could be used with the invention. The semi-automatic power balancing system includes cylinders 18 and 20, fuel injectors 30 and 32, and ECU 12 which has the method for semi-automatic power balancing programmed into memory 43. The system does not require pressure transducers 48 and 50.

When semi-automatic method and system are started in Step 200, ECU 12 waits for a key or button (not shown) to be pressed or for a switch (not shown) to be turned on. (Step 202). When the key is pressed or the switch is turned on, then an ON signal is sent to ECU 12 which then checks the output from shaft encoder 14 to determine if the speed of engine 10 is greater than a preset limit. (Step 204) In this particular embodiment, ECU 12 checks the output from shaft encoder 14 to determine if the speed of engine 10 is greater than 270 revolutions per minute (RPMs). The particular value chosen for the preset limit can vary as needed and desired. If the speed of engine 10 is less than the preset limit, then the NO branch is taken to Step 202 where ECU 12 again waits for an ON signal to be transmitted from the key or switch as described above.

Note that FIG. 6 only represents the on-line program stored in memory 43 in ECU 12. The semi-automatic balancing method and system involves an off-line process to acquire the peak firing pressure measurements for each cylinder 18 and 20 which are then transferred to ECU 12. The peak firing pressure measurements are taken when engine 10 is operating at a speed and load deemed suitable for semi-automatic power balancing. A peak firing pressure measuring and analyzing device (not shown), such as the BETA-TRAP produced by Beta Monitors & Controls Ltd. Calgary, Alberta, Canada, T3C 0J7, can be used to measure and electronically save peak firing pressure measurements for each of the engine's cylinders 18 and 20. The peak firing pressure measuring and analyzing device converts the peak pressure measurements into peak firing pressure signals and then transfers the signals to a buffer (not shown) in ECU 12. A connector (not shown) can be used to interface the peak firing pressure measuring and analyzing device with the buffer in ECU 12 to transfer the signals in a manner well known to those skilled in the art.

Returning back to the on-line process illustrated in FIG. 6, if the engine speed is greater than the preset limit, then the YES branch is taken to Step 244 where ECU 12 checks for the presence of peak firing pressure signals in the buffer. If there are no peak firing pressure signals in the buffer in ECU 12, then the NO branch is taken from Step 244 to Step 246. In Step 246, a display (not shown) signals the operator that peak firing pressure signals for each of the cylinders 18 and 20 have not been found and then returns to Step 202.

If the buffer in ECU 12 has peak firing pressure signals, then the YES branch is taken from Step 244 to Step 206. In Step 206, the peak firing pressure signals are read from the buffer, stripped of unwanted signals, and put into memory 43 in ECU 12. The peak firing pressure signals are in the order in which the data was taken by the operator of the peak firing pressure measuring and analyzing device. If necessary, Step 206 resorts the peak firing pressure signals into proper firing order sequence for cylinders 18 and 20.

In Step 208, a sensitivity parameter Q is generated. To generate sensitivity parameter Q, first one of the cylinders 18 or 20 is selected and the balance factor for the cylinder 18 or 20 is changed a fixed percentage $PR_{kw}$. In this particular embodiment, the fixed percentage $PR_{kw}$ is eight percent. Next, the average peak firing pressure for the cylinder 18 or 20 is measured and the percentage change $PF_{rfp}$ in average peak firing pressure is determined. In this particular embodiment, the percentage change $PF_{rfp}$ in average peak firing pressure is nine percent. For engine 10, the fixed percentage $PR_{kw}$ and the percentage change $PF_{rfp}$ in average peak firing pressure only need to be determined once during the initial setup. Once fixed percentage $PR_{kw}$ and percentage change $PF_{rfp}$ are determined, the values are stored in memory 43 in ECU 12 as constants and are not recalculated each rebalancing cycle. Next, ECU 12 with the fixed percentage $PR_{kw}$ and the percentage change $PF_{rfp}$ in average peak firing pressure generates sensitivity parameter Q during each rebalancing cycle as follows:

$$Q=P_{rfp}{}^{*}PF_{ib}/(KW_{ib}-KWAV_b/KWAV_a{}^{*}(KW_{ib}-PR_{kw}))$$

where:

$P_{rfp}$=fractional change in average peak firing pressure of cylinder i after a known percentage change to the balance factor for cylinder i $PF_{ib}$=average peak firing pressure in cylinder i before the change to the balance factor $KW_{ib}$=old or current balance factor for cylinder i $PR_{kw}$=the fixed percentage change in the initial balance factor for cylinder i $KWAV_b$=average of all balance factors before the change to the balance factor for cylinder i $KWAV_a$=$KWAV_b$-($PR_{kw}$ the number of cylinders)

Once sensitivity parameter Q is generated, the system and method for rebalancing power goes to Step 210.

In Step 210, ECU 12 averages the old balance factors for cylinders and 20 in engine 10 together and generates a first average signal and then assigns a second average signal representing the average of the new balance factors to be equal to the first average signal for the first iteration in determining new balance factors for each of the cylinders 18 and 20. In this particular embodiment, the working balance factors, old balance factors, and new balance factors range from zero to one hundred percent, preferably being between seventy and one-hundred percent.

With the old balance factors, the average peak firing pressure signals for cylinders 18 and 20 (representing the average peak firing pressure in each of the cylinders 18 and 20), the sensitivity constant Q, a third average signal generated by ECU 12 by averaging the average peak firing pressure signals for each of the cylinders 18 and 20, the first average signal and the second average signal, ECU 12 generates a new balance factor for each cylinder 18 and 20. (Step 212). More specifically, ECU 12 generates a new balance factor for each cylinder 18 and 20 as follows:

$$KW_{ia}=(KW_{ib}-((PF_{ib}-PFAV_b)\div Q))\times(KWAV_a\div KWAV_b)$$

where:

$KW_{ia}$=new balance factor for cylinder i $KW_{ib}$=old balance factor for cylinder i $PF_{ib}$=average peak firing pressure in cylinder i before new balance factor is calculated $PFAV_b$=average of all average peak firing pressure signals for all cylinders Q=sensitivity constant $KWAV_a$=average of all new balance factors for all cylinders $KWAV_b$=average of all old balance factors for all cylinders Once ECU 12 has generated a new balance factor for each cylinder 18 and 20, ECU 12 determines which of the new balance factors is the highest or maximum new balance factor and generates a first difference signal by subtracting the maximum new balance factor from a preset upper limit. (Step 214). Preferably, the preset upper limit is set at one-hundred percent, although the particular value for the preset upper limit can vary as needed and desired. If the first difference signal which represents the difference between the maximum new balance factor and a preset upper limit is greater than a predetermined amount, then the YES branch is taken to Step 216. In this particular embodiment, the predetermined amount is 0.4%, although the amount can vary as needed and desired.

In Step 2 16, the second average signal, representing the average of the new balance factors, is adjusted and then the new balance factors are recalculated in Step 212. More specifically, the second average signal value is adjusted as follows:

$$KWAV_a = KWAV_a + 100 - KW_{ia}[\max]$$

The iterative process in Steps 212, 214 and 216 is repeated until first difference signal, which represents the difference between the maximum new balance factor and a preset upper limit, is not greater than the predetermined amount and then the NO branch is taken from Step 214 to Step 218.

In Step 218, ECU 12 determines which of the new balance factors is the lowest or minimum new balance factor and then compares the minimum new balance factor against a preset lower limit. In this particular, embodiment, the preset lower limit is seventy percent, although the value of the preset lower limit can vary as needed and desired. If the minimum new balance factor is lower than the preset lower limit, then the YES branch is taken from Step 220 where ECU 12 signals an alarm system (not shown) to set off an alarm and resets all of the new balance factors to one-hundred percent. The alarm signals the operator that engine 10 needs attention because one of the cylinders 18 or 20 is producing substantially less power than the other. The reduced power from the cylinder 18 or 20 may be due to misfiring or mechanical malfunction. Step 218 prevents the situation in which one of the cylinders 18 or 20 could be receiving an excess of fuel while the "good" cylinder got little or none. Such a situation would result in engine 10 stopping and possibly resulting in a dangerous build-up of fuel in the exhaust ducting in 52 and 54.

If the minimum new balance factor is not less than the preset lower limit than the NO branch from step 218 is taken to step 248 where a message is displayed in a display (not shown) to inform the operator that the re-balancing was completed. In step 222, the old working balancing factors are replaced with the new balance factors. If the YES branch is taken from step 218, then as described above in Step 220 the new balance factors are set to 100% and in Step 222 the old working balancing factors are replaced with the new balance factors.

Next, as described in greater detail previously in the application, the working balance factors which were set equal to the new balance factors are multiplied with the working pulse width for each cylinder 18 and 20 of engine 10 and then the output pulses from this multiplication are sent to an output stage which converts the voltages to currents which can be used by the fuel injection actuator 31 to operate the valve 34 in the fuel injector 30 and adjust the duration of the injection. The adjustment to the duration of fuel injection with the new working balance factors helps to balance power between cylinders 18 and 20 which improves engine smoothness, helps to control and regulate emissions, and increases the life of engine 10.

Figures 7, 7A:
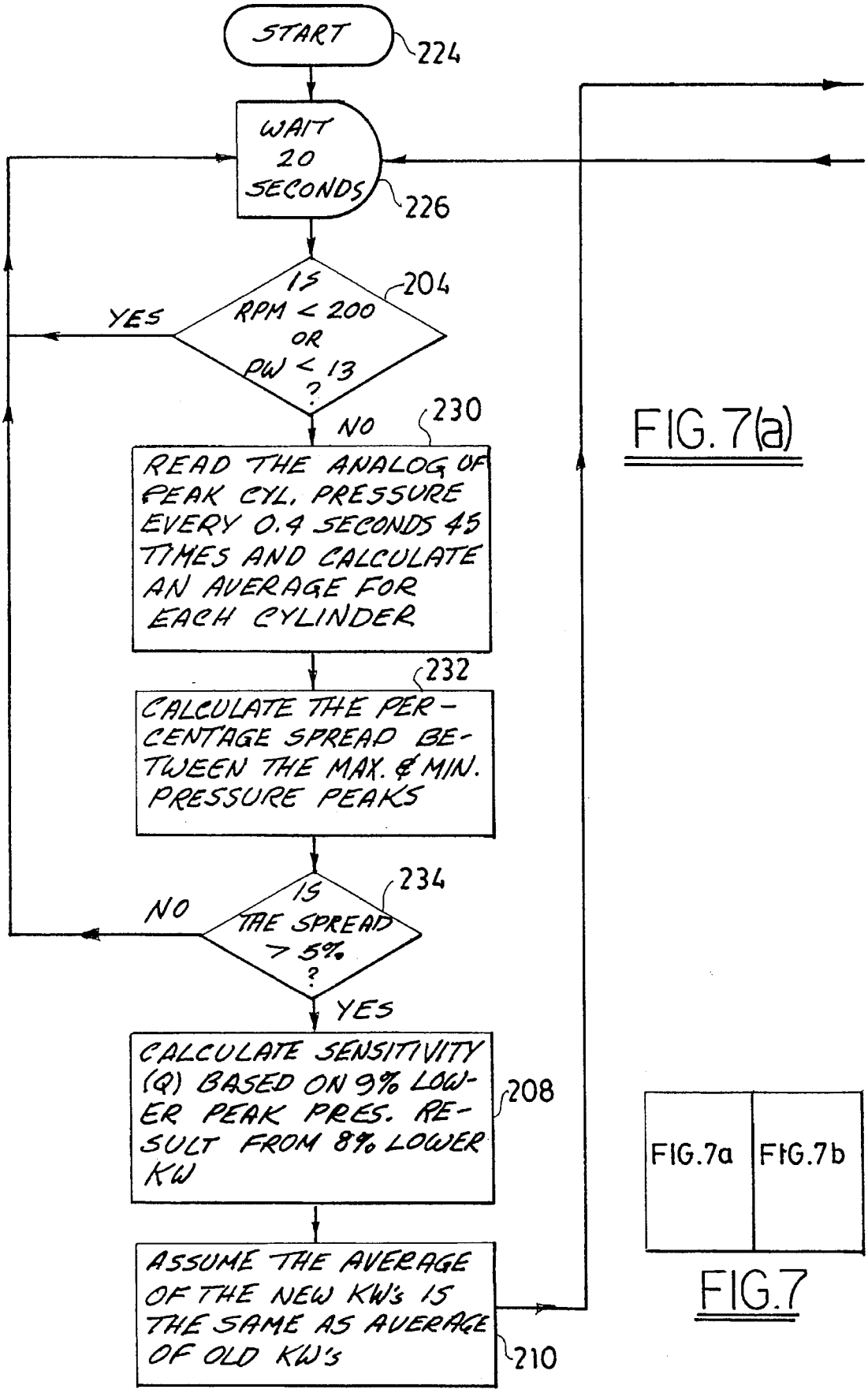
FIG. 7 is a flow chart illustrating the fully-automatic operation of the power balancing system.

Referring to FIG. 7, a flow chart of the operation of the fully-automatic power balancing system is illustrated. Corresponding steps in FIG. 7 have numeral designations which correspond to those numeral designations used in FIG. 6 and thus those steps will not be described again here. Like the semi-automatic power balancing system, the fully-automatic power balancing system, includes cylinders 18 and 20, fuel injectors 30 and 32, and ECU 12 which has the method for fully-automatic power balancing programmed into memory 43. Fully automatic power balancing system also includes pressure transducer 48 and 50 which are coupled to ECU 12.

When ECU 12 is started in Step 224, ECU 12 first waits a predetermined period of time. (Step 226). In this particular embodiment, the predetermined period of time is twenty seconds, although the time can vary as needed and desired. The delay enables engine 10 to pick up some speed before the engine speed is checked. Once the twenty second delay has passed, ECU 12 checks the output from shaft encoder 14 to determine if the speed of engine 10 is greater than a preset limit, as described in greater detail above. (Step 204) If the speed of engine 10 is less than the preset limit, then the YES branch is taken back to Step 226 where ECU 12 again waits a predetermined period of time before proceeding to Step 204.

If ECU 12 determines that the speed of engine 10 is greater than the preset limit, then the NO branch is taken to Step 230 where pressure transducers 48 and 50 measure the peak firing pressures in cylinders 18 and 20. Suitable electronics, not shown, but readily constructed by those familiar with the art, produce an analog voltage signal that is proportional to the peak firing pressure measured by pressure transducers 48 and 50. Either directly or through multiplexing, these analog voltage signals which represent the peak firing pressure measurements for cylinders 18 and 20 are converted by an analog-to-digital (A/D) converter (not shown) at an input in ECU 12 to digital voltage signals representative of the peak firing pressure measurements for cylinders 18 and 20 in Step 230. Within Step 230 analog voltage signals are read in preset intervals, in this particular example the signals are read every 0.4 seconds although the time of the interval can vary as desired. The analog voltage signals are also read a preset number of times, in this particular example 45 times, before an average peak firing pressure signal for each of the cylinders 18 and 20 is generated.

Once the average peak firing pressure signals have been generated for each cylinder 18 and 20, then ECU 12 calculates the percentage spread between the maximum average peak firing pressure signal and the minimum average peak firing pressure signal. (Step 232). If the percentage spread between the maximum average peak firing pressure signal and the minimum average peak firing pressure signal is less than five percent, the NO branch is taken back to Step 226. Although a five percent spread is used in this particular embodiment, the particular spread can vary as needed and desired. If the percentage spread between the maximum average peak firing pressure signal and the minimum average peak firing pressure signal is more than five percent, the YES branch is taken to Step 208 where the sensitivity constant Q is determined as explained in greater detail previously. The remaining steps of the fully automatic power balancing are the same as those for the semi-automatic power balancing system described above with reference to FIG. 6 and thus will not be describe again here. The fully automatic power balancing system continually adjusts the duration of fuel injection with new working balance factors helping to automatically balance power between cylinders 18 and 20 and thus to improve engine smoothness, help to control and regulate emissions, and to increase the life of engine 10.

Having thus considered the basic concept of the invention, it will be readily apparent to those skilled in the art that the foregoing detailed disclosure is intended to be presented by way of example only and is not limiting. Various alterations, improvements, and modifications will occur to those skilled in the art, though not expressly stated herein. These modifications, alterations and improvements are intended to be covered hereby, and are within the spirit and scope of the invention.

What is claimed is:

1. A method for balancing power between at least two cylinders in an internal combustion engine, the engine having a computer with a memory programmed to balance power output by the cylinders, said method comprising the steps of:

injecting fuel into each cylinder for a set period of time determined by a working pulse width signal adjusted by a working balance factor which ranges from a first specified percentage to one-hundred percent;

measuring peak firing pressure in each of the cylinders;

generating an average peak firing pressure signal for each of the cylinders from the measurements of the peak firing pressure in each of the cylinders;

generating a new balance factor for each of the cylinders in an iterative process from the working balance factors for each of the cylinders, a sensitivity constant, and the average peak firing pressure signal for each of the cylinders until at least one of the new balance factors is within a first preset amount of one hundred percent; and replacing the working balance factor for each of the cylinders with the new balance factor for each of the cylinders.

2. The method as set forth in claim 1 wherein said generating a new balance factor for each of the cylinders comprises the steps of:

generating a first average signal by averaging all of the average peak firing pressure signals;

generating a first difference signal by subtracting the first average signal from the average peak firing pressure signal for the cylinder;

generating a first quotient signal by dividing the first difference signal by the sensitivity constant;

generating a second difference signal by subtracting the first quotient signal from the working balance factor for the cylinder;

generating a second average signal by averaging the working balance factors;

assigning a third average signal which represents an average of the new balance factors to be equal to the second average signal for the first iteration of generating new balance factors;

generating a second quotient signal by dividing the second average signal by the third average signal; and generating the new balance factor for the cylinder by multiplying the second difference signal by the second quotient signal.

3. The method as set forth in claim 2 further comprising the steps of:

selecting the new balance factor with the highest percentage;

generating a third difference signal by subtracting the new balance factor with the highest percentage from one-hundred percent; and adjusting the third average signal by adding the third difference signal to the third average signal and then repeating the step of generating a new balance factor for each of the cylinders if the third difference signal is greater than the first preset amount.

4. The method as set forth in claim 3 wherein the first preset amount is 0.4 percent.

5. The method as set forth in claim 1 further comprising the step of:

triggering an alarm signal if any of the new balance factors is less than a second specified percentage.

6. The method as set forth in claim 1 further comprising the step of delaying adjustment of the new balance factors if a reading of revolutions per minute for the engine is less than a second preset amount.

7. The method as set forth in claim 1 wherein the second preset amount is 270 revolutions per minute.

8. A fuel control system in an internal combustion engine, the system balancing power between at least two cylinders in the internal combustion engine, said system comprising:

means for injecting fuel into each cylinder for a set period of time determined by a working pulse width signal adjusted by a working balance factor which ranges from a first specified percentage to one-hundred percent;

means for measuring peak firing pressure in each of the cylinders;

means for generating an average peak firing pressure signal for each of the cylinders from the measurements of the peak firing pressure in each of the cylinders;

means for generating a new balance factor for each of the cylinders in an iterative process from the working balance factors for each of the cylinders, a sensitivity constant, and the average peak firing pressure signal for each of the cylinders until at least one of the new balance factors is within a first preset amount of one hundred percent; and means for replacing the working balance factor for each of the cylinders with the new balance factor for each of the cylinders.

9. The system as set forth in claim 8 wherein said means for generating a new balance factor for each of the cylinders comprises:

means for generating a first average signal by averaging all of the average peak firing pressure signals;

means for generating a first difference signal by subtracting the first average signal from the average peak firing pressure signal for the cylinder;

means for generating a first quotient signal by dividing the first difference signal by the sensitivity constant;

means for generating a second difference signal by subtracting the first quotient signal from the Working balance factor for the cylinder;

means for generating a second average signal by averaging the working balance factors;

means for assigning a third average signal which represents an average of the new balance factors to be equal to the second average signal for the first iteration of generating new balance factors;

means for generating a second quotient signal by dividing the second average signal by the third average signal; and means for generating the new balance factor for the cylinder by multiplying the second difference signal by the second quotient signal.

10. The system as set forth in claim 9 further comprising:

means for selecting the new balance factor with the highest percentage;

means for generating a third difference signal by subtracting the new balance factor with the highest percentage from one-hundred percent; and means for adjusting the third average signal by adding the third difference signal to the third average signal, said means for generating a new balance factor for each of the cylinders using the new third average signal if the third difference signal is greater than the first preset amount.

11. The system as set forth in claim 10 wherein the first preset amount is 0.4 percent.

12. The system as set forth in claim 8 further comprising means for triggering an alarm signal if any of the new balance factors is less than a second specified percentage.

13. The system as set forth in claim 8 further comprising the means for delaying adjustment of the new balance factors if a reading of revolutions per minute for the engine is less than a second preset amount.

14. The system as set forth in claim 8 wherein the second preset amount is 270 revolutions per minute.

15. A fuel control system in an internal combustion engine, the system balancing power between at least two cylinders in the internal combustion engine, the engine including a computer with a memory programmed to balance power between the cylinders, each of the cylinders having a fuel injector which injects fuel into the cylinder for the duration of a working pulse width signal, said system comprising:

a pressure measuring device for measuring peak firing pressure in each of the cylinders;

means for generating an average peak firing pressure signal for each of the cylinders from the measurements of the peak firing pressure in each of the cylinders;

means for generating a new balance factor for each of the cylinders from a working balance factor for each of the cylinders, the new balance factors for each of the cylinders assigned initially to be equal to the working balance factors, a first average signal representative of an average of all of the working balance factors, a second average signal representative of an average of all of the new balance factors, a sensitivity constant, and the average peak firing pressure signal for each of the cylinders;

means for generating a first difference signal by subtracting the new balance factor with the highest percentage from a first preset amount;

means for adjusting the second average signal by adding the first difference signal to the second average signal if the first difference signal is greater than a first preset amount, the means for generating a new balance factor for each of the cylinders using the second average signal from the means for adjusting;

means for replacing the working balance factor for each of the cylinders with the new balance factor for each of the cylinders when the first difference signal is less than the first preset amount; and means for adjusting the working pulse width signal for each of the cylinders by multiplying the working pulse width signal with the new balance factor from the means for replacing.

16. The system as set forth in claim 15 wherein the first preset amount is 0.4 percent.

17. The system as set forth in claim 15 further comprising means for triggering an alarm signal if any of the new balance factors is less than a second specified percentage.

18. The system as set forth in claim 15 further comprising means for delaying adjustment of the new balance factors if a reading of revolutions per minute for the engine is less than a second preset amount.

19. The system as set forth in claim 15 wherein the second preset amount is 200 revolutions per minute.

20. The system as set forth in claim 15 further comprising means for generating the sensitivity constant by adjusting the working balance factor for one of the cylinders a selected amount and then measuring the resulting change in the peak firing pressure signal for the cylinder.

21. A fuel control system in an internal combustion engine, the system balancing power between at least two cylinders in the internal combustion engine from peak firing pressure measurements for each of the cylinders said system comprising:

a fuel injector in each of the cylinders which injects fuel into the cylinder for a set period of time determined by a working pulse width signal adjusted by a working balance factor which ranges from a first specified percentage to one-hundred percent;

means for generating an average peak firing pressure signal for each of the cylinders from the measurements of peak firing pressure in each of the cylinders;

means for generating a new balance factor for each of the cylinders in an iterative process from the working balance factors for each of the cylinders, a sensitivity constant, and the average peak firing pressure signal for each of the cylinders until at least one of the new balance factors is within a first preset amount of one hundred percent;

means for replacing the working balance factor for each of the cylinders with the new balance factor for each of the cylinders;

means for adjusting the working pulse width signal for each of the cylinders by multiplying the working pulse width signal with the new balance factor from the means for replacing.

22. The system as set forth in claim 21 wherein said means for generating a new balance factor for each of the cylinders comprises:

means for generating a first average signal by averaging all of the average peak firing pressure signals;

means for generating a first difference signal by subtracting the first average signal from the average peak firing pressure signal for the cylinder;

means for generating a first quotient signal by dividing the first difference signal by the sensitivity constant;

means for generating a second difference signal by subtracting the first quotient signal from the working balance factor for the cylinder;

means for generating a second average signal by averaging the working balance factors;

means for assigning a third average signal which represents an average of the new balance factors to be equal to the second average signal for the first iteration of generating new balance factors;

means for generating a second quotient signal by dividing the second average signal by the third average signal; and means for generating the new balance factor for the cylinder by multiplying the second difference signal by the second quotient signal.

23. The system as set forth in claim 22 further comprising:

means for selecting the new balance factor with the highest percentage;

means for generating a third difference signal by subtracting the new balance factor with the highest percentage from one-hundred percent; and means for adjusting the third average signal by adding the third difference signal to the third average signal, said means for generating a new balance factor for each of the cylinders using the new third average signal if the third difference signal is greater than the first preset amount.

24. The system as set forth in claim 23 wherein the first preset amount is 0.4 percent.

25. The system as set forth in claim 21 further comprising means for triggering an alarm signal if any of the new balance factors is less than a second specified percentage.

26. The system as set forth in claim 21 further comprising the means for delaying adjustment of the new balance factors if a reading of revolutions per minute for the engine is less than a second preset amount.

27. The system as set forth in claim 21 wherein the second preset amount is 200 revolutions per minute.

* * * * *